US011139559B2

(12) United States Patent
Wei

(10) Patent No.: US 11,139,559 B2
(45) Date of Patent: Oct. 5, 2021

(54) MOBILE DEVICE AND ANTENNA STRUCTURE

(71) Applicant: Wistron NeWeb Corp., Hsinchu (TW)

(72) Inventor: Shih-Chiang Wei, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 195 days.

(21) Appl. No.: 16/669,719

(22) Filed: Oct. 31, 2019

(65) Prior Publication Data

US 2020/0274230 A1 Aug. 27, 2020

(30) Foreign Application Priority Data

Feb. 26, 2019 (TW) ..... 108106433

(51) Int. Cl.
*H01Q 1/24* (2006.01)
*H01Q 5/357* (2015.01)
*H01Q 5/385* (2015.01)

(52) U.S. Cl.
CPC ..... *H01Q 1/244* (2013.01); *H01Q 5/357* (2015.01); *H01Q 5/385* (2015.01)

(58) Field of Classification Search
CPC ..... H01Q 1/243; H01Q 1/244; H01Q 1/48; H01Q 5/357; H01Q 5/385; H01Q 5/364; H01Q 13/10
See application file for complete search history.

(56) References Cited

U.S. PATENT DOCUMENTS

| | | | | |
|---|---|---|---|---|
| 9,190,713 | B2 * | 11/2015 | Eom | H01Q 1/243 |
| 10,056,696 | B2 | 8/2018 | Tseng et al. | |
| 10,381,715 | B2 * | 8/2019 | Han | H01Q 5/328 |
| 10,490,902 | B2 * | 11/2019 | Yen | H01Q 13/10 |
| 2008/0266190 | A1 | 10/2008 | Ohba et al. | |
| 2009/0153409 | A1 * | 6/2009 | Chiang | H01Q 1/243 343/702 |

(Continued)

FOREIGN PATENT DOCUMENTS

| | | |
|---|---|---|
| CN | 103682563 A | 3/2014 |
| CN | 109546298 A | 3/2019 |

(Continued)

*Primary Examiner* — Awat M Salih
(74) *Attorney, Agent, or Firm* — McClure, Qualey & Rodack, LLP

(57) ABSTRACT

A mobile device includes a metal mechanism element, a ground plane, a first parasitic radiation element, a second parasitic radiation element, a feeding radiation element, and a dielectric substrate. The metal mechanism element has a slot. The first parasitic radiation element and the second parasitic radiation element are both coupled to the metal mechanism element. The first parasitic radiation element and the second parasitic radiation element both extend across the slot. The feeding radiation element is disposed between the first parasitic radiation element and the second parasitic radiation element. An antenna structure is formed by the feeding radiation element, the first parasitic radiation element, the second parasitic radiation element, and the slot of the metal mechanism element. The antenna structure covers at least a first frequency band. The length of the slot is shorter than 0.48 wavelength of the first frequency band.

20 Claims, 9 Drawing Sheets

(56) References Cited

U.S. PATENT DOCUMENTS

| | | | | |
|---|---|---|---|---|
| 2009/0231215 | A1* | 9/2009 | Taura | H01Q 1/243 343/702 |
| 2012/0306718 | A1* | 12/2012 | Koyanagi | H01Q 1/521 343/853 |
| 2014/0168025 | A1* | 6/2014 | Chang | H01Q 13/106 343/770 |
| 2015/0236426 | A1* | 8/2015 | Zhu | H01Q 1/2266 343/702 |
| 2015/0263430 | A1* | 9/2015 | Lin | H01Q 13/10 343/767 |
| 2017/0005414 | A1 | 1/2017 | Yang | |
| 2017/0033467 | A1* | 2/2017 | Huang | H01Q 5/357 |
| 2017/0162948 | A1* | 6/2017 | Wong | H01Q 21/06 |
| 2017/0207542 | A1* | 7/2017 | Tseng | H01Q 13/106 |
| 2017/0214136 | A1* | 7/2017 | Irci | H01Q 5/10 |
| 2018/0048076 | A1* | 2/2018 | Wei | H01Q 9/045 |
| 2018/0062243 | A1* | 3/2018 | Yang | H01Q 1/36 |
| 2018/0269578 | A1* | 9/2018 | Wu | H01Q 5/321 |
| 2019/0198975 | A1* | 6/2019 | Chen | H01Q 1/48 |
| 2019/0214721 | A1* | 7/2019 | Hu | H01Q 1/521 |

FOREIGN PATENT DOCUMENTS

| | | | |
|---|---|---|---|
| TW | 201703350 | A | 1/2017 |
| TW | M537316 | U | 2/2017 |

* cited by examiner

MOBILE DEVICE AND ANTENNA STRUCTURE

CROSS REFERENCE TO RELATED APPLICATIONS

This application claims priority of Taiwan Patent Application No. 108106433 filed on Feb. 26, 2019, the entirety of which is incorporated by reference herein.

BACKGROUND OF THE INVENTION

Field of the Invention

The disclosure generally relates to a mobile device, and more particularly, it relates to a mobile device and an antenna structure therein.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

In order to improve their appearance, designers often incorporate metal elements into mobile devices. However, these newly added metal elements tend to negatively affect the antennas used for wireless communication in mobile devices, thereby degrading the overall communication quality of the mobile devices. As a result, there is a need to propose a novel mobile device with a novel antenna structure, so as to overcome the problems of the prior art.

BRIEF SUMMARY OF THE INVENTION

In an exemplary embodiment, the disclosure is directed to a mobile device which includes a metal mechanism element, a ground plane, a first parasitic radiation element, a second parasitic radiation element, a feeding radiation element, and a dielectric substrate. The metal mechanism element has a slot. The slot has a first closed end and a second closed end. The first parasitic radiation element is coupled to the metal mechanism element. The first parasitic radiation element extends across the slot. The second parasitic radiation element is coupled to the metal mechanism element. The second parasitic radiation element extends across the slot. The feeding radiation element has a feeding point. The feeding radiation element is disposed between the first parasitic radiation element and the second parasitic radiation element. The dielectric substrate is disposed adjacent to the metal mechanism element. The feeding radiation element, the first parasitic radiation element, and the second parasitic radiation element are all disposed on the dielectric substrate. An antenna structure is formed by the feeding radiation element, the first parasitic radiation element, the second parasitic radiation element, and the slot of the metal mechanism element. The antenna structure covers at least a first frequency band. The length of the slot is shorter than 0.48 wavelength of the first frequency band.

In some embodiments, the ground plane is a conductive material extending from the metal mechanism element onto the dielectric substrate. The ground plane and the first parasitic radiation element or the second parasitic radiation element at least partially extend in opposite directions.

In some embodiments, the antenna structure has an asymmetrical pattern.

In some embodiments, the feeding radiation element has a variable-width structure.

In some embodiments, the slot is positioned between a first side region and a second side region. The first end of the first parasitic radiation element and the first end of the second parasitic radiation element are coupled to the metal mechanism element within the first side region. The feeding point is positioned in the second side region. The second end of the first parasitic radiation element and the second end of the second parasitic radiation element extend across the slot into the second side region.

In some embodiments, at least a portion of each of the first parasitic radiation element and the second parasitic radiation element substantially has a U-shape. The feeding radiation element is at least partially disposed between the open side of the first parasitic radiation element and the open side of the second parasitic radiation element.

In some embodiments, the first parasitic radiation element further includes a protruding portion. The protruding portion substantially has a straight-line shape.

In some embodiments, the antenna structure further covers a second frequency band. The first frequency band is from 2400 MHz to 2500 MHz. The second frequency band is from 5150 MHz to 5850 MHz.

In some embodiments, the length of the first parasitic radiation element is substantially equal to 0.5 wavelength of the second frequency band.

In some embodiments, the length of the second parasitic radiation element is substantially equal to 0.5 wavelength of the second frequency band.

In some embodiments, the mobile device further includes a first additional radiation element coupled to the first parasitic radiation element. The first additional radiation element substantially has a straight-line shape.

In some embodiments, the mobile device further includes a second additional radiation element coupled to the second parasitic radiation element. The second additional radiation element substantially has a straight-line shape.

In some embodiments, the mobile device further includes a tuning radiation element and a circuit element. The tuning radiation element extends across the slot. The tuning radiation element includes a first portion and a second portion. The first portion and the second portion are respectively coupled to the metal mechanism element. The circuit element is coupled between the first portion and the second portion of the tuning radiation element.

In some embodiments, a vertical projection of the circuit element is completely inside the slot.

In some embodiments, the circuit element is a resistor, an inductor, a capacitor, a switch element, or a combination thereof.

In some embodiments, the antenna structure further covers a second frequency band, a third frequency band, and a fourth frequency band. The first frequency band is from 699 MHz to 960 MHz. The second frequency band is from 1710 MHz to 2690 MHz. The third frequency band is from 3400 MHz to 4300 MHz. The fourth frequency band is from 5150 MHz to 5925 MHz.

In some embodiments, the length of the first parasitic radiation element is substantially equal to 0.5 wavelength of the second frequency band.

In some embodiments, the length of the second parasitic radiation element is substantially equal to 0.5 wavelength of the third frequency band.

In some embodiments, the mobile device further includes a thickening layer disposed between the dielectric substrate and the metal mechanism element.

In an exemplary embodiment, the disclosure is directed to an antenna structure which includes a metal mechanism element, a ground plane, a first parasitic radiation element, a second parasitic radiation element, a feeding radiation element, and a dielectric substrate. The metal mechanism element has a slot. The slot has a first closed end and a second closed end. The first parasitic radiation element is coupled to the metal mechanism element. The first parasitic radiation element extends across the slot. The second parasitic radiation element is coupled to the metal mechanism element. The second parasitic radiation element extends across the slot. The feeding radiation element has a feeding point. The feeding radiation element is disposed between the first parasitic radiation element and the second parasitic radiation element. The dielectric substrate is disposed adjacent to the metal mechanism element. The feeding radiation element, the first parasitic radiation element, and the second parasitic radiation element are all disposed on the dielectric substrate. The antenna structure covers at least a first frequency band. The length of the slot is shorter than 0.48 wavelength of the first frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
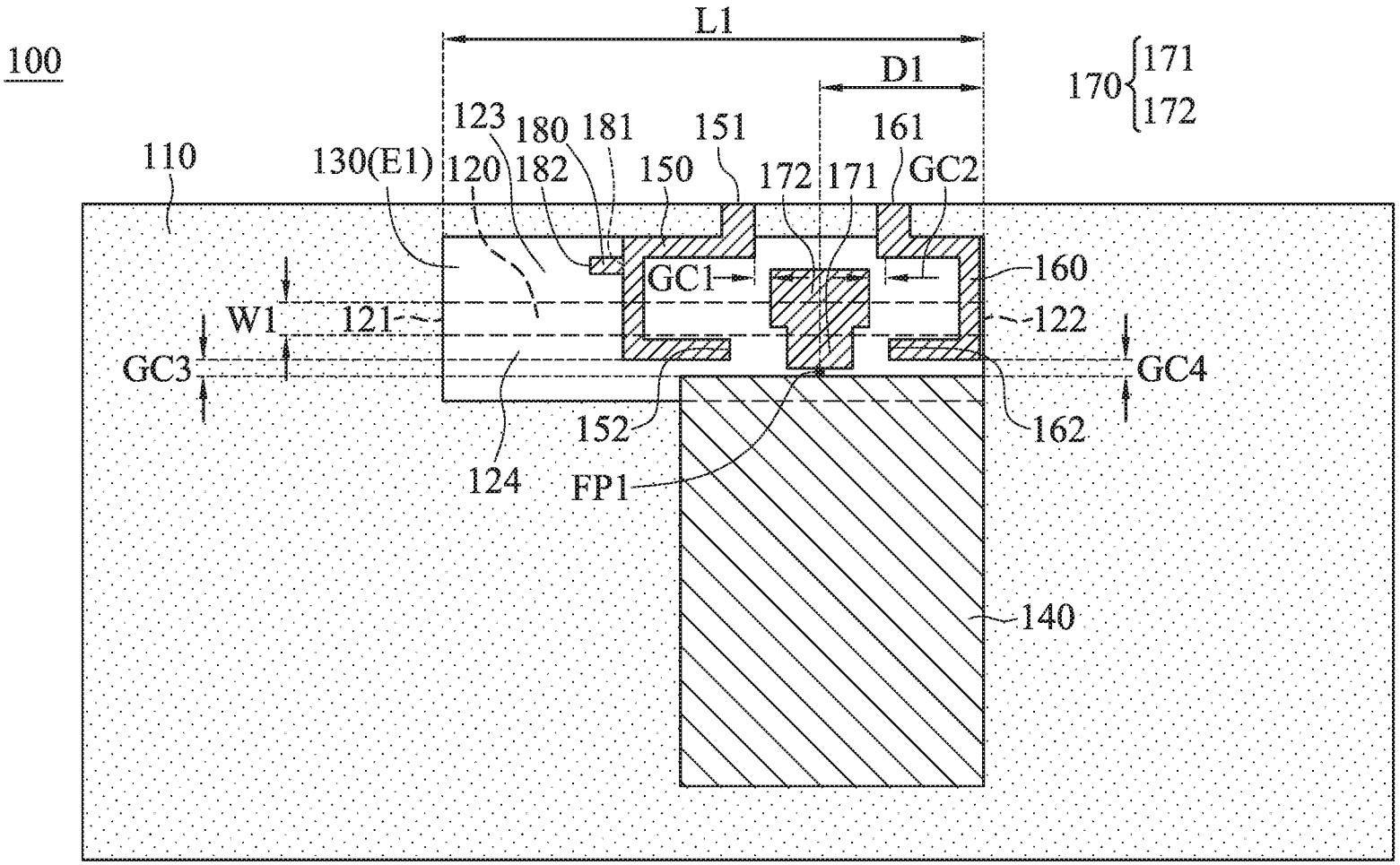
FIG. 1A is a top view of a mobile device according to an embodiment of the invention.
Figure 1B:
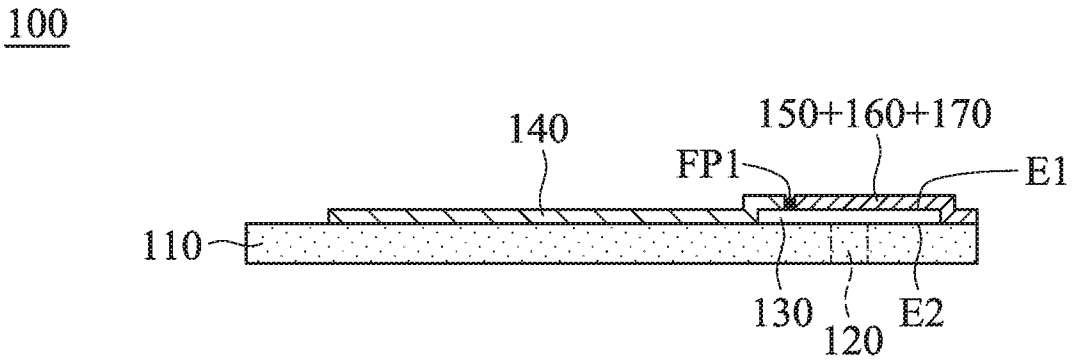
FIG. 1B is a side view of a mobile device according to an embodiment of the invention.

FIG. 1A is a top view of a mobile device 100 according to an embodiment of the invention. FIG. 1B is a side view of the mobile device 100 according to an embodiment of the invention. For example, the mobile device 100 may be a smartphone, a tablet computer, or a notebook computer. Please refer to FIG. 1A and FIG. 1B together. As shown in FIG. 1A and FIG. 1B, the mobile device 100 includes a metal mechanism element 110, a dielectric substrate 130, a ground plane 140, a first parasitic radiation element 150, a second parasitic radiation element 160, and a feeding radiation element 170. The ground plane 140, the first parasitic radiation element 150, the second parasitic radiation element 160, and the feeding radiation element 170 may all be made of metal materials, such as copper, silver, aluminum, iron, or their alloys. It should be understood that the mobile device 100 may further include a touch control panel, a display device, a speaker, a battery module, and/or a housing although they are not displayed in FIG. 1A and FIG. 1B. In alternative embodiments, FIG. 1A and FIG. 1B are considered as an antenna structure including all of the elements of the mobile device 100.

The metal mechanism element 110 may be a metal housing of the mobile device 100. In some embodiments, the metal mechanism element 110 is a metal upper cover of a notebook computer or a metal back cover of a tablet computer, but it is not limited thereto. For example, if the mobile device 100 is a notebook computer, the metal mechanism element 110 may be the so-called "A-component" in the field of notebook computer. The metal mechanism element 110 has a slot 120. The slot 120 of the metal mechanism element 110 may substantially have a straight-line shape. Specifically, the slot 120 has a first closed end 121 and a second closed end 122 which are away from each other. The mobile device 100 may further include a nonconductive material, which fills the slot 120 of the metal mechanism element 110, so as to provide the functions of waterproof or dustproof.

The dielectric substrate 130 may be an FR4 (Flame Retardant 4) substrate, a PCB (Printed Circuit Board), or an FCB (Flexible Circuit Board). The dielectric substrate 130 has a first surface E1 and a second surface E20 which are opposite to each other. The first parasitic radiation element 150, the second parasitic radiation element 160, and the feeding radiation element 170 are all disposed on the first surface E1 of the dielectric substrate 130. The second surface E2 of the dielectric substrate 130 is adjacent to the slot 120 of the metal mechanism element 110. It should be noted that the term "adjacent" or "close" over the disclosure means that the distance (spacing) between two corresponding elements is smaller than a predetermined distance (e.g., 5 mm or shorter), or means that the two corresponding elements directly touch each other (i.e., the aforementioned distance/spacing therebetween is reduced to 0). In some embodiments, the second surface E2 of the dielectric substrate 130 is directly attached to the metal mechanism element 110, and the dielectric substrate 130 extends across the slot 120 of the metal mechanism element 110. The ground plane 140 may be implemented with a conductive material, such as a copper foil, an aluminum foil, a conductive cloth, a conductive sponge, or a spring, which may substantially have a stepped-shape. For example, the ground plane 140 may be coupled to the metal mechanism element 110, and the ground plane 140 may extend from the metal mechanism element 110 onto the first surface E1 of the dielectric substrate 130. The ground plane 140 and the first parasitic radiation element 150 or the second parasitic radiation element 160 at least partially extend in opposite directions. For example, the ground plane 140 may extend toward a lower side of the slot 120, and the first parasitic radiation element 150 and the second parasitic radiation element 160 may extend toward an upper side of the slot 120. In some embodiments, an antenna structure is formed by the first parasitic radiation element 150, the second parasitic radiation element 160, the feeding radiation element 170, and the slot 120 of the metal mechanism element 110. In some embodiments, the antenna structure of the mobile device 100 has an asymmetrical pattern. In alternative embodiments, adjustments are made such that the antenna structure of the mobile device 100 has a symmetrical pattern.

The first parasitic radiation element 150 may at least partially have a U-shape. An open side of the aforementioned U-shape may face the feeding radiation element 170. The first parasitic radiation element 150 has a first end 151 and a second end 152. The first end 151 of the first parasitic radiation element 150 is coupled to the metal mechanism element 110. The second end 152 of the first parasitic radiation element 150 extends across the whole width W1 of the slot 120 toward the ground plane 140. That is, the first parasitic radiation element 150 has a first vertical projection on the metal mechanism element 110, and the first vertical projection at least partially overlaps the slot 120 of the metal mechanism element 110.

The second parasitic radiation element 160 may at least partially have a U-shape. An open side of the aforementioned U-shape may face the feeding radiation element 170. In other words, the feeding radiation element 170 is at least partially disposed between the open side of the first parasitic radiation element 150 and the open side of the second parasitic radiation element 160. The second parasitic radiation element 160 has a first end 161 and a second end 162. The first end 161 of the second parasitic radiation element 160 is coupled to the metal mechanism element 110. The second end 162 of the second parasitic radiation element 160 extends across the whole width W1 of the slot 120 toward the ground plane 140. That is, the second parasitic radiation element 160 has a second vertical projection on the metal mechanism element 110, and the second vertical projection at least partially overlaps the slot 120 of the metal mechanism element 110.

Specifically, the slot 120 is positioned between a first side region 123 and a second side region 124. For example, the first side region 123 may be positioned on the upper side of the slot 120, and the second side region 124 may be positioned on the lower side of the slot 120, but they are not limited thereto. The first end 151 of the first parasitic radiation element 150 and the first end 161 of the second parasitic radiation element 160 are coupled to the metal mechanism element 110 within the first side region 123. The second end 152 of the first parasitic radiation element 150 and the second end 162 of the second parasitic radiation element 160 extend across the slot 120 into the second side region 124. The second end 152 of the first parasitic radiation element 150 and the second end 162 of the second parasitic radiation element 160 further extend toward the feeding radiation element 170.

It should be noted that the first parasitic radiation element 150 and the second parasitic radiation element 160 are both directly coupled to a portion of the metal mechanism element 110 above the slot 120, and they are not directly coupled to the ground plane 140 below the slot 120. According to practical measurements, such a design can improve the bandwidth and matching characteristics of the antenna structure of the mobile device 100. Furthermore, the incorporation of the first parasitic radiation element 150 and the second parasitic radiation element 160 can solve the problem of the slot 120 whose length L1 does not reach 0.5 wavelength of the corresponding resonant frequency.

The feeding radiation element 170 may substantially have a T-shape. The feeding radiation element 170 is positioned between the first parasitic radiation element 150 and the second parasitic radiation element 160. Specifically, the feeding radiation element 170 may have a variable-width structure including a narrow portion 171 and a wide portion 172. A feeding point FP1 is positioned on the narrow portion 171 of the feeding radiation element 170. The wide portion 172 of the feeding radiation element 170 is coupled through the narrow portion 171 of the feeding radiation element 170 to the feeding point FP1. The feeding point FP1 may be coupled to a signal source (not shown). For example, the signal source may be an RF (Radio Frequency) module for exciting the antenna structure of the mobile device 100. The feeding point FP1 may be positioned in the second side region 124 of the slot 120. In alternative embodiments, the feeding radiation element 170 may have a straight-line shape, a trapezoidal shape, or a triangular shape, but it is not limited thereto.

A first coupling gap GC1 may be formed between the feeding radiation element 170 and the first end 151 of the first parasitic radiation element 150. A second coupling gap GC2 may be formed between the feeding radiation element 170 and the first end 161 of the second parasitic radiation element 160. A third coupling gap GC3 may be formed between the ground plane 140 and the second end 152 of the first parasitic radiation element 150. A fourth coupling gap GC4 may be formed between the ground plane 140 and the second end 162 of the second parasitic radiation element 160. Each of the aforementioned coupling gaps is configured to enhance the coupling effect between the corresponding elements.

In some embodiments, the first parasitic radiation element 150 further includes a protruding branch 180, which may be made of a metal material. The protruding branch 180 may substantially have a straight-line shape or a rectangular shape. The protruding branch 180 has a first end 181 and a second end 182. The first end 181 of the protruding branch 180 is coupled to a bending portion of the first parasitic radiation element 150. The second end 182 of the protruding element 180 is an open end, which extends away from the other portions of the first parasitic radiation element 150. The protruding branch 180 is configured to fine-tune the matching characteristics of the antenna structure of the mobile device 100. It should be understood that the protruding branch 180 is merely an optional element, which may be omitted in other embodiments.

Figure 2:
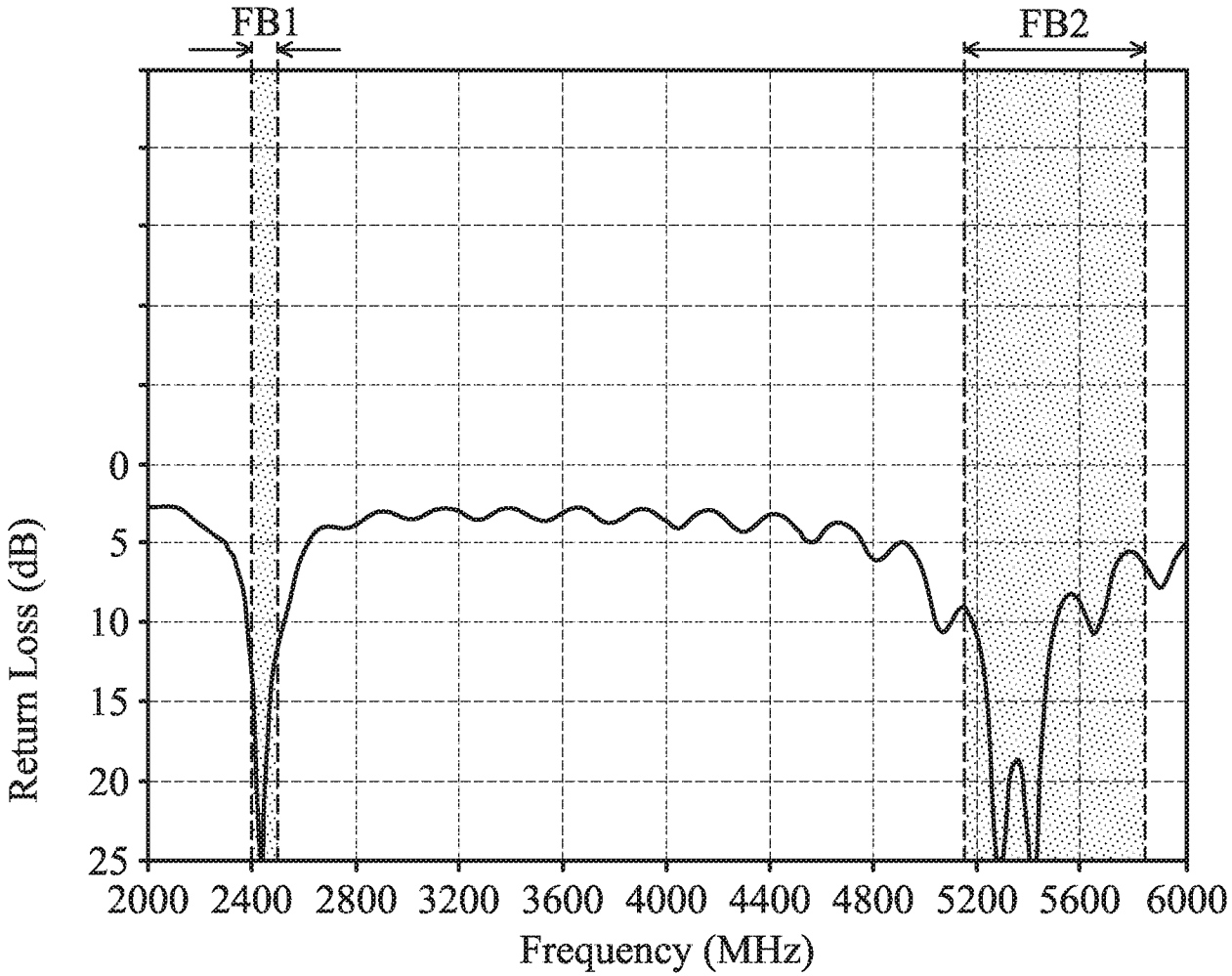
FIG. 2 is a diagram of return loss of an antenna structure of a mobile device according to an embodiment of the invention.

FIG. 2 is a diagram of return loss of the antenna structure of the mobile device 100 according to an embodiment of the invention. According to the measurement of FIG. 2, the antenna structure of the mobile device 100 can cover a first frequency band FB1 and a second frequency band FB2. The first frequency band FB1 may be from about 2400 MHz to about 2500 MHz. The second frequency band FB2 may be from about 5150 MHz to about 5850 MHz. Therefore, the antenna structure of the mobile device 100 can support at least the dual-band operations of WLAN (Wireless Local Area Network) 2.4 GHz/5 GHz. With respect to the antenna theory, the feeding radiation element 170 and the slot 120 of the metal mechanism element 110 can be exited to generate the first frequency band FB1 and the second frequency band FB2. Both of the first parasitic radiation element 150 and the second parasitic radiation element 160 are configured to fine-tune the frequency shift amount and the impedance matching of the first frequency band FB1 and the second frequency band FB2. According to practical measurements, the length L1 of the slot 120 of the metal mechanism element 110 (i.e., the length LI from the first closed end 121 to the second closed end 122) may be shorter than 0.48 wavelength (0.48λ) of the first frequency band FB1. Therefore, the incorporation of the first parasitic radiation element 150 and the second parasitic radiation element 160 helps to minimize the total size of the antenna structure of the mobile device 100.

Figure 3:
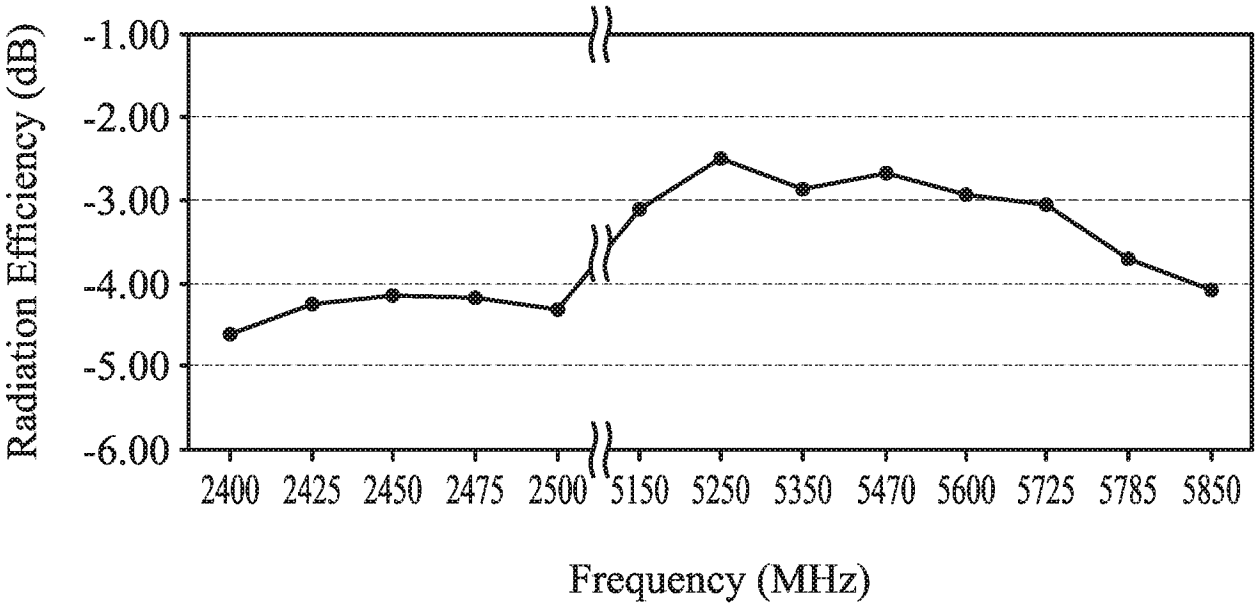
FIG. 3 is a diagram of radiation efficiency of an antenna structure of a mobile device according to an embodiment of the invention.

FIG. 3 is a diagram of radiation efficiency of the antenna structure of the mobile device 100 according to an embodiment of the invention. According to the measurement of FIG. 3, the radiation efficiency of the antenna structure of the mobile device 100 can be about −4 dB within the first frequency band FB1, and the radiation efficiency of the antenna structure of the mobile device 100 can be about −2.5 dB within the second frequency band FB2. This can meet the requirements of practical applications of general mobile communication devices.

In some embodiments, the element sizes of the mobile device 100 are described as follows. The length L1 of the slot 120 may be substantially equal to 0.4 wavelength (0.4λ) of the first frequency band FB1. The width W1 of the slot 120 may be from 1 mm to 5 mm. The distance D1 between the feeding point FP1 and the second closed end 122 of the slot 120 may be from 0.15 to 0.5 times the length L1 of the slot 120. That is, the feeding point FP1 may be closer to the second closed end 122 of the slot 120 than the first closed end 121 of the slot 120. The length of the first parasitic radiation element 150 (i.e., the length from the first end 151 to the second end 152) may be substantially equal to 0.5 wavelength (0.5λ) of the second frequency band FB2. The length of the second parasitic radiation element 160 (i.e., the length from the first end 161 to the second end 162) may be substantially equal to 0.5 wavelength (0.5λ) of the second frequency band FB2. The width of each of the first coupling gap GC1, the second coupling gap GC2, the third coupling gap GC3, and the fourth coupling gap GC4 may be from 0.2 mm to 2 mm, or may be from 2 mm to 20 mm. The above ranges of element sizes are calculated and obtained according to many experiment results, and they help to optimize the operation bandwidth and impedance matching of the antenna structure of the mobile device 100.

Figure 4A:
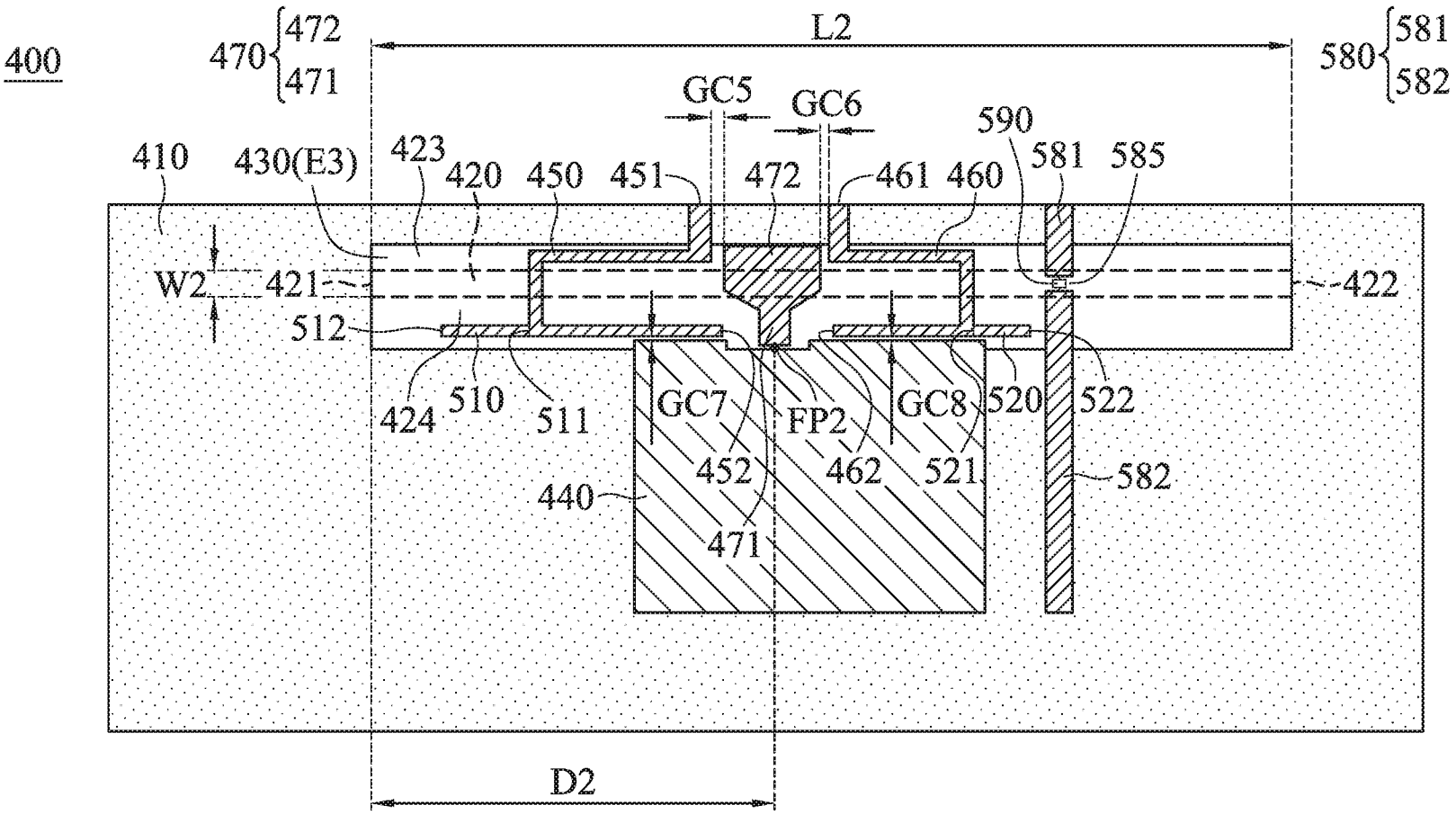
FIG. 4A is a top view of a mobile device according to another embodiment of the invention.
Figure 4B:
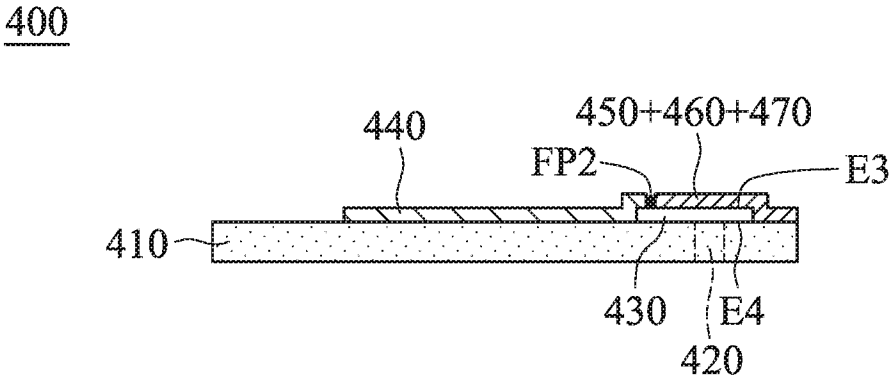
FIG. 4B is a side view of a mobile device according to another embodiment of the invention.

FIG. 4A is a top view of a mobile device 100 according to another embodiment of the invention. FIG. 4B is a side view of the mobile device 100 according to another embodiment of the invention. Please refer to FIG. 4A and FIG. 4B together, which may be considered as modified configurations of FIG. 1A and FIG. 1B. As shown in FIG. 4A and FIG. 4B, the mobile device 400 includes a metal mechanism element 410, a dielectric substrate 430, a ground plane 440, a first parasitic radiation element 450, a second parasitic radiation element 460, a feeding radiation element 470, a first additional radiation element 510, a second additional radiation element 520, a tuning radiation element 580, and a circuit element 590. The ground plane 440, the first parasitic radiation element 450, the second parasitic radiation element 460, the feeding radiation element 470, the first additional radiation element 510, the second additional radiation element 520, and the tuning radiation element 580 may all be made of metal materials. In alternative embodiments, FIG. 4A and FIG. 4B are considered as an antenna structure including all of the elements of the mobile device 400.

The metal mechanism element 410 may be a metal housing of the mobile device 400. The metal mechanism element 410 has a slot 420. The slot 420 of the metal mechanism element 410 may substantially have a straight-line shape. Specifically, the slot 420 has a first closed end 421 and a second closed end 422 which are away from each other. The mobile device 400 may further include a non-conductive material, which fills the slot 420 of the metal mechanism element 410.

The dielectric substrate 430 has a first surface E3 and a second surface E4 which are opposite to each other. The first parasitic radiation element 450, the second parasitic radiation element 460, the feeding radiation element 470, the first additional radiation element 510, the second additional radiation element 520, the tuning radiation element 580, and the circuit element 590 are all disposed on the first surface E3 of the dielectric substrate 430. The second surface E4 of the dielectric substrate 430 is adjacent to the slot 420 of the metal mechanism element 410. In some embodiments, the second surface E4 of the dielectric substrate 430 is directly attached to the metal mechanism element 410, and the dielectric substrate 430 extends across the slot 420 of the metal mechanism element 410. The ground plane 440 may be implemented with a conductive material, such as a copper foil, an aluminum foil, a conductive cloth, a conductive sponge, or a spring, which may substantially have a stepped-shape or a bevel-shape. For example, the ground plane 440 may be coupled to the metal mechanism element 410, and the ground plane 440 may extend from the metal mechanism element 410 onto the first surface E3 of the dielectric substrate 430. In some embodiments, an antenna structure is formed by the first parasitic radiation element 450, the second parasitic radiation element 460, the feeding radiation element 470, the first additional radiation element 510, the second additional radiation element 520, the tuning radiation element 580, the circuit element 590, and the slot 420 of the metal mechanism element 410.

The first parasitic radiation element 450 may at least partially have a U-shape and at least partially surround the feeding radiation element 470. An open side of the aforementioned U-shape may face the feeding radiation element 470. The first parasitic radiation element 450 has a first end 451 and a second end 452. The first end 451 of the first parasitic radiation element 450 is coupled to the metal mechanism element 410. The second end 452 of the first parasitic radiation element 450 extends across the whole width W2 of the slot 420 toward the ground plane 440. That is, the first parasitic radiation element 450 has a first vertical projection on the metal mechanism element 410, and the first vertical projection at least partially overlaps the slot 420 of the metal mechanism element 410.

The first additional radiation element 510 may substantially have a straight-line shape. The first additional radiation element 510 has a first end 511 and a second end 512. The first end 511 of the first additional radiation element 510 is coupled to a bending portion of the first parasitic radiation element 450. The second end 512 of the first additional radiation element 510 is an open end, which extends away from the first parasitic radiation element 450. The first additional radiation element 510 is configured to fine-tune the operation frequency of the antenna structure of the mobile device 400.

The second parasitic radiation element 460 may at least partially have a U-shape and at least partially surround the feeding radiation element 470. An open side of the aforementioned U-shape may face the feeding radiation element 470. In other words, the feeding radiation element 470 is at least partially disposed between the open side of the first parasitic radiation element 450 and the open side of the second parasitic radiation element 460. The second parasitic radiation element 460 has a first end 461 and a second end 462. The first end 461 of the second parasitic radiation element 460 is coupled to the metal mechanism element 410. The second end 462 of the second parasitic radiation element 460 extends across the whole width W2 of the slot 420 toward the ground plane 440. That is, the second parasitic radiation element 460 has a second vertical projection on the metal mechanism element 410, and the second vertical projection at least partially overlaps the slot 420 of the metal mechanism element 410.

The second additional radiation element 520 may substantially have a straight-line shape. The second additional radiation element 520 has a first end 521 and a second end 522. The first end 521 of the second additional radiation element 520 is coupled to a bending portion of the second parasitic radiation element 460. The second end 522 of the second additional radiation element 520 is an open end, which extends away from the second parasitic radiation element 460. In addition, the second end 522 of the second additional radiation element 520 and the second end 512 of the first additional radiation element 510 substantially extend away from each other. The second additional radiation element 520 is also configured to fine-tune the operation frequency of the antenna structure of the mobile device 400.

Specifically, the slot 420 is positioned between a first side region 423 and a second side region 424. For example, the first side region 423 may be positioned on the upper side of the slot 420, and the second side region 424 may be positioned on the lower side of the slot 420, but they are not limited thereto. The first end 451 of the first parasitic radiation element 450 and the first end 461 of the second parasitic radiation element 460 are coupled to the metal mechanism element 410 within the first side region 423. The second end 452 of the first parasitic radiation element 450 and the second end 462 of the second parasitic radiation element 460 extend across the slot 420 into the second side region 424. The second end 452 of the first parasitic radiation element 450 and the second end 462 of the second parasitic radiation element 460 further extend toward the feeding radiation element 470.

It should be noted that the first parasitic radiation element 450 and the second parasitic radiation element 460 are both directly coupled to a portion of the metal mechanism element 410 above the slot 420, and they are not directly coupled to the ground plane 440 below the slot 420. According to practical measurements, such a design can improve the bandwidth and matching characteristics of the antenna structure of the mobile device 400.

The feeding radiation element 470 may substantially have a T-shape. The feeding radiation element 470 is positioned between the first parasitic radiation element 450 and the second parasitic radiation element 460. Specifically, the feeding radiation element 470 may have a variable-width structure including a narrow portion 471 and a wide portion 472. A feeding point FP2 is positioned on the narrow portion 471 of the feeding radiation element 470. The wide portion 472 of the feeding radiation element 470 is coupled through the narrow portion 471 of the feeding radiation element 470 to the feeding point FP2. The feeding point FP2 may be coupled to a signal source for exciting the antenna structure of the mobile device 400. The feeding point FP2 may be positioned in the second side region 424 of the slot 420. In alternative embodiments, the feeding radiation element 470 may have a straight-line shape, a trapezoidal shape, or a triangular shape, but it is not limited thereto.

A first coupling gap GC5 may be formed between the feeding radiation element 470 and the first end 451 of the first parasitic radiation element 450. A second coupling gap GC6 may be formed between the feeding radiation element 470 and the first end 461 of the second parasitic radiation element 460. A third coupling gap GC7 may be formed between the ground plane 440 and the second end 452 of the first parasitic radiation element 450. A fourth coupling gap GC8 may be formed between the ground plane 440 and the second end 462 of the second parasitic radiation element 460.

The tuning radiation element 580 may substantially have a straight-line shape. The tuning radiation element 580 extends across the whole width W2 of the slot 420. Specifically, the tuning radiation element 580 includes a first portion 581 and a second portion 582, and a partition gap 585 is formed between the first portion 581 and the second portion 582. The first portion 581 and the second portion 582 of the tuning radiation element 580 are respectively coupled to the metal mechanism element 410. That is, each of the first portion 581 and the second portion 582 of the tuning radiation element 580 extends from the first surface E3 of the dielectric substrate 430 onto the metal mechanism element 410. The circuit element 590 is positioned in the partition gap 585. The circuit element 590 is coupled in series between the first portion 581 and the second portion 582 of the tuning radiation element 580. The circuit element 590 has a third vertical projection on the metal mechanism element 110, and the whole third vertical projection is inside the slot 420. In some embodiments, the circuit element 590 is a resistor, an inductor, a capacitor, a switch element, or a combination thereof. For example, the aforementioned resistor may be a fixed resistor or a variable resistor, the aforementioned inductor may be a fixed inductor or a variable inductor, and the aforementioned capacitor may be a fixed capacitor or a variable capacitor. In addition, the aforementioned switch element may operate in a closed state or an open state. It should be noted that no matter which side the tuning radiation element 580 and the circuit element 590 are positioned at, i.e., the left side or the right side of the feeding radiation element 470, it can control the operation frequency band (or frequency shift) of the antenna structure, or increase the operation bandwidth of the antenna structure of the mobile device 400.

Figure 5:
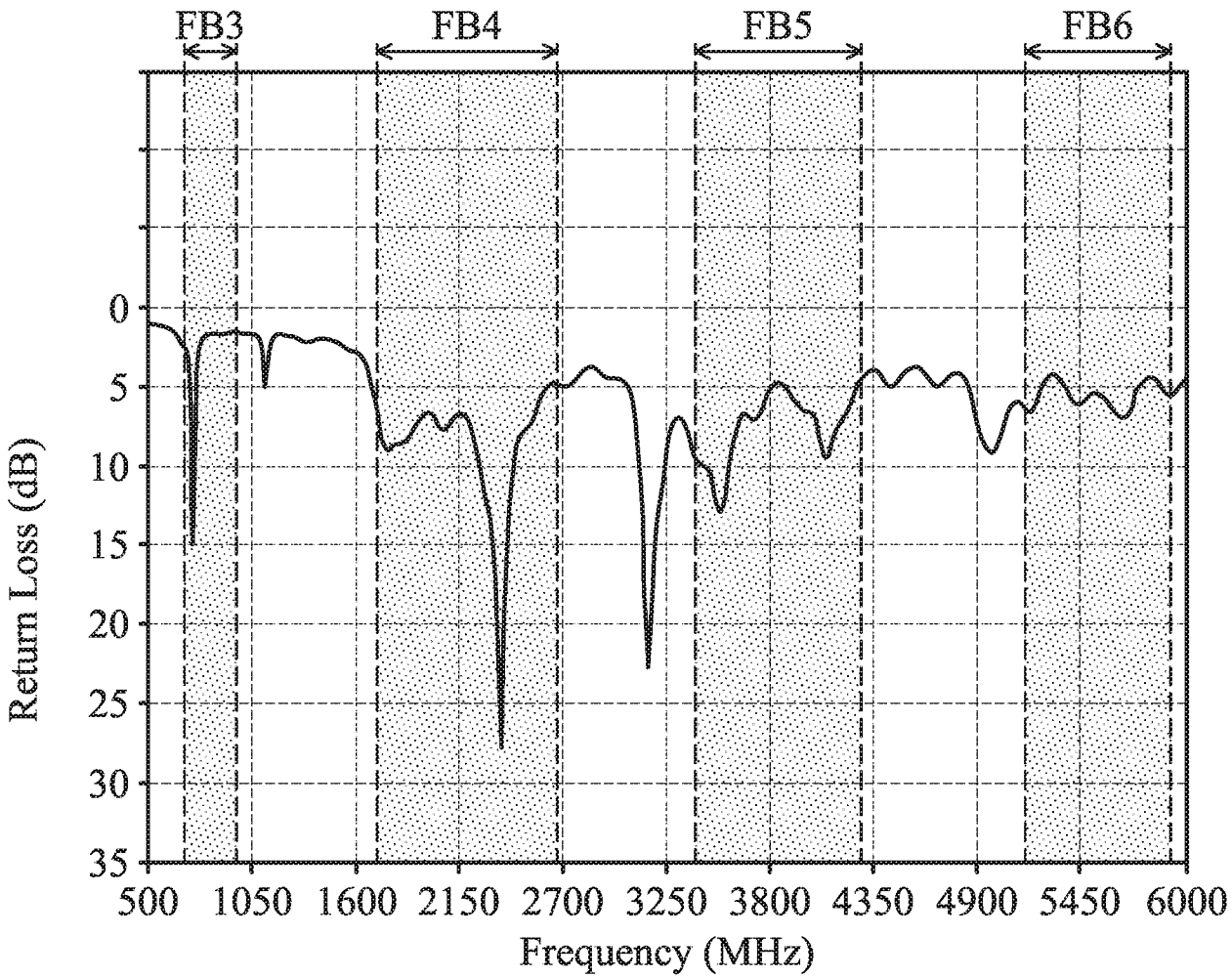
FIG. 5 is a diagram of return loss of an antenna structure of a mobile device according to another embodiment of the invention.

FIG. 5 is a diagram of return loss of the antenna structure of the mobile device 400 according to another embodiment of the invention. According to the measurement of FIG. 5, the antenna structure of the mobile device 400 can cover a first frequency band FB3, a second frequency band FB4, a third frequency band FB5, and a fourth frequency band FB6.

The first frequency band FB3 may be from about 699 MHz to about 960 MHz. The second frequency band FB4 may be from about 1710 MHz to about 2690 MHz. The third frequency band FB5 may be from about 3400 MHz to about 4300 MHz. The fourth frequency band FB6 may be from about 5150 MHz to about 5925 MHz. Therefore, the antenna structure of the mobile device 400 can support at least the multiband operations of LTE (Long Term Evolution). With respect to antenna theory, the feeding radiation element 470 and the slot 420 of the metal mechanism element 410 can be exited to generate the first frequency band FB3, the second frequency band FB4, the third frequency band FB5, and the fourth frequency band FB6. The first parasitic radiation element 450 is configured to fine-tune the frequency shift amount and the impedance matching of the first frequency band FB3 and the third frequency band FB5. The second parasitic radiation element 460 is configured to fine-tune the frequency shift amount and the impedance matching of the first frequency band FB3, the second frequency band FB4, the third frequency band FB5, and the fourth frequency band FB6. The circuit element 590 is configured to change the effective impedance value and the short-circuited boundary relative to the slot 420, thereby mainly adjusting the frequency range of the first frequency band FB3. For example, if the circuit element 590 has a very small resistance or a very large capacitance to form a short-circuited path, it may be equivalent to that the second closed end 422 of the slot 420 is moved toward the left, thereby increasing the operation frequency of the antenna structure. Conversely, if the circuit element 590 has a very large resistance or a very small capacitance to form an open-circuited path, it may be equivalent to that the second closed end 422 of the slot 420 is maintained at the original position, thereby decreasing the operation frequency of the antenna structure. In other word, if the capacitance of the circuit element 590 increases, the first frequency band FB3 may become lower, and if the inductance of the circuit element 590 increases, the first frequency band FB3 may become higher. In response to a change in the impedance value of the circuit element 590, the frequency ranges of the second frequency band FB4, the third frequency band FB5, and the fourth frequency band FB6 may be correspondingly adjusted. In some embodiments, the circuit element 590 adjusts its impedance value according to a control signal from a processor (not shown), so as to increase the operation bandwidth of the antenna structure of the mobile device 400. According to practical measurements, the length L2 of the slot 420 of the metal mechanism element 410 (i.e., the length L2 from the first closed end 421 to the second closed end 422) may be shorter than 0.45 wavelength (0.45λ) of the first frequency band FB3. Therefore, the incorporation of the first parasitic radiation element 450, the second parasitic radiation element 460, the first additional radiation element 510, the second additional radiation element 520, the tuning radiation element 580, and the circuit element 590 helps to minimize the total size of the antenna structure of the mobile device 400.

Figure 6:
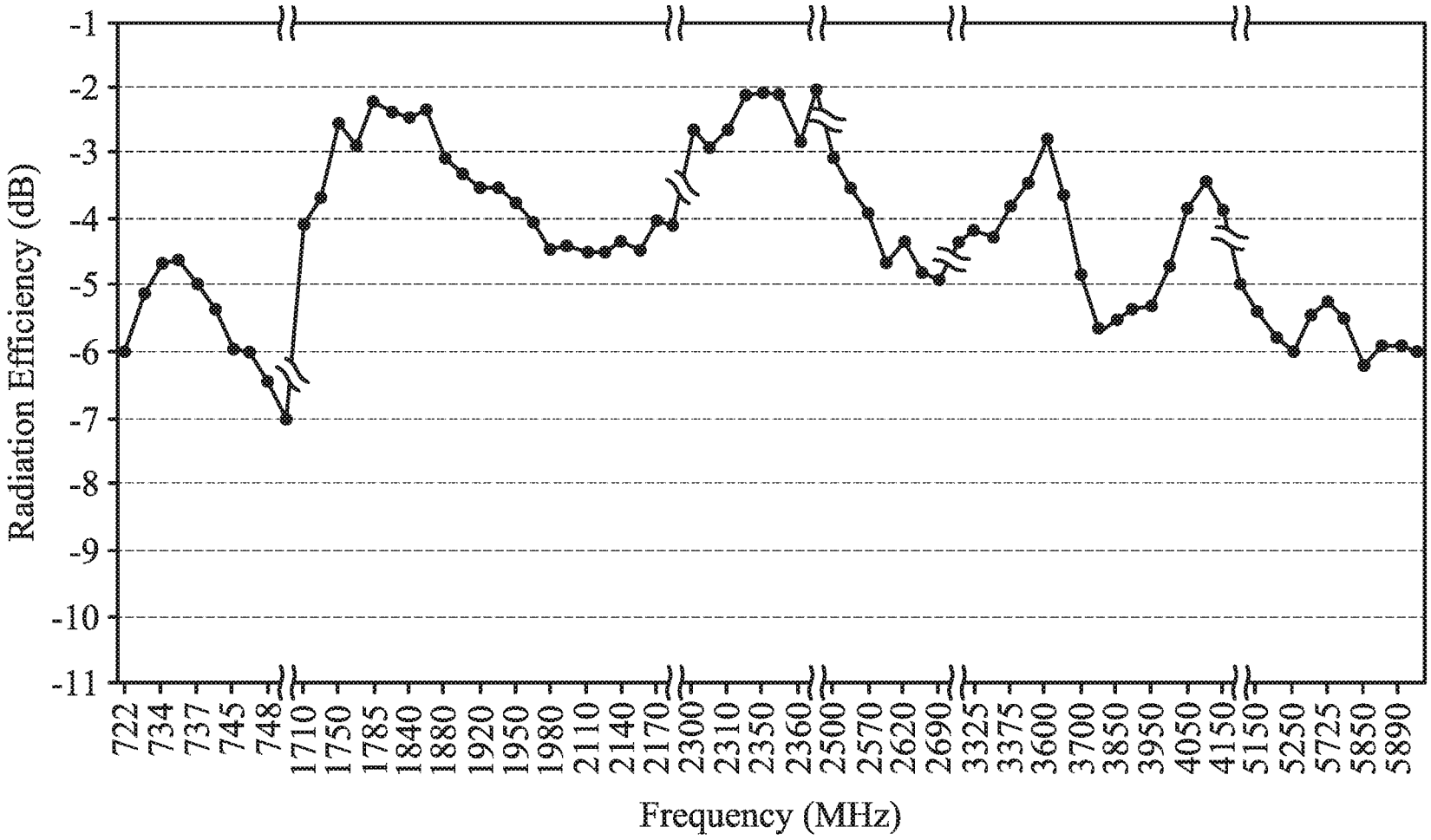
FIG. 6 is a diagram of radiation efficiency of an antenna structure of a mobile device according to another embodiment of the invention.

FIG. 6 is a diagram of radiation efficiency of the antenna structure of the mobile device 400 according to another embodiment of the invention. According to the measurement of FIG. 6, the radiation efficiency of the antenna structure of the mobile device 400 can be about −4.5 dB within the first frequency band FB3, the radiation efficiency of the antenna structure of the mobile device 100 can be about −2 dB within the second frequency band FB4, the radiation efficiency of the antenna structure of the mobile device 400 can be about −3 dB within the third frequency band FB5, and the radiation efficiency of the antenna structure of the mobile device 400 can be about −5.5 dB within the fourth frequency band FB6. This can meet the requirements of practical applications of general mobile communication devices.

In some embodiments, the element sizes of the mobile device 400 are described as follows. The length L2 of the slot 420 may be substantially equal to 0.4 wavelength (0.4λ) of the first frequency band FB3. The width W2 of the slot 420 may be from 1 mm to 5 mm, such as 3 mm. The distance D2 between the feeding point FP2 and the first closed end 421 of the slot 420 may be from 0.15 to 0.5 times the length L2 of the slot 420. That is, the feeding point FP2 may be closer to the first closed end 421 of the slot 420 than the second closed end 422 of the slot 420. The length of the first parasitic radiation element 450 (i.e., the length from the first end 451 to the second end 452) may be substantially equal to 0.5 wavelength (0.5λ) of the second frequency band FB4. The length of the second parasitic radiation element 460 (i.e., the length from the first end 461 to the second end 462) may be substantially equal to 0.5 wavelength (0.5λ) of the third frequency band FB3. That is, the length of the first parasitic radiation element 450 may be slightly longer than the length of the second parasitic radiation element 460. The width of each of the first coupling gap GC5, the second coupling gap GC6, the third coupling gap GC7, and the fourth coupling gap GC8 may be from 0.2 mm to 2 mm, or may be from 2 mm to 20 mm. The above ranges of element sizes are calculated and obtained according to many experiment results, and they help to optimize the operation bandwidth and impedance matching of the antenna structure of the mobile device 400.

Figure 7:
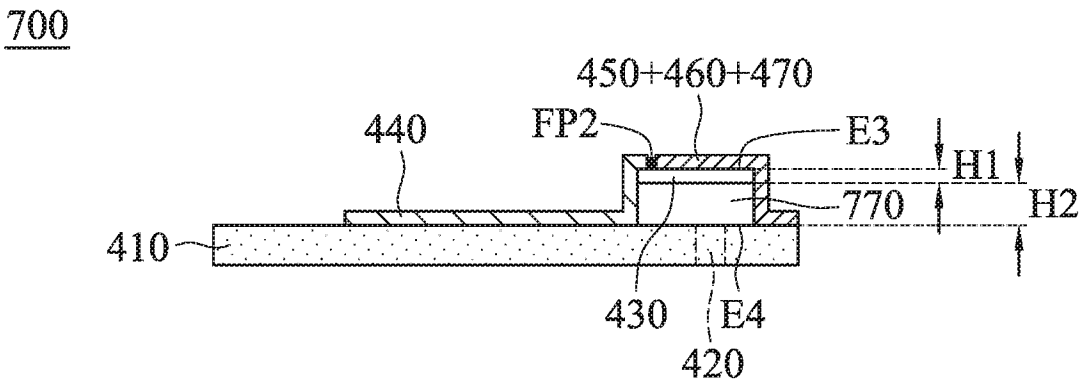
FIG. 7 is a side view of a mobile device according to another embodiment of the invention.

FIG. 7 is a side view of a mobile device 700 according to another embodiment of the invention. FIG. 7 is similar to FIG. 4B. In the embodiment of FIG. 7, the mobile device 700 further includes a thickening layer 770. Both the dielectric substrate 430 and the thickening layer 770 may be made of nonconductive materials. The thickening layer 770 is disposed between the dielectric substrate 430 and the metal mechanism element 410. For example, the thickening layer 770 may directly touch the metal mechanism element 110, and the thickening layer 770 may be configured to support the second surface E4 of the dielectric substrate 430. The dielectric constant of the thickening layer 770 may be the same as or different from the dielectric constant of the dielectric substrate 130. The height H2 of the thickening layer 770 may be greater than or equal to the height H1 of the dielectric substrate 430. For example, the height H2 of the thickening layer 770 may 1 to 10 times the height H1 of the dielectric substrate 430. According to practical measurements, the incorporation of the thickening layer 770 can increase a portion of the operation bandwidth and the radiation efficiency of the antenna structure of the mobile device 400. Alternatively, the thickening layer 770 may be applied to the mobile device 100 of FIG. 1B (disposed between the dielectric substrate 130 and the metal mechanism element 110). Other features of the mobile device 700 of FIG. 7 are similar to those of the mobile devices 100 and 400 of FIG. 1A, FIG. 1B, FIG. 4A and FIG. 4B. Accordingly, these embodiments can achieve similar levels of performance.

The invention proposes a novel mobile device and a novel antenna structure, which are integrated with a metal mechanism element. The metal mechanism element does not negatively affect the radiation performance of the antenna structure because the metal mechanism element is considered as an extension portion of the antenna structure. Furthermore, because of the incorporation of the first parasitic radiation element and the second parasitic radiation element, the slot length of the antenna structure of the invention does not necessarily reach 0.5 wavelength of the corresponding operation frequency, thereby minimizing the total antenna size. In comparison to the conventional design, the invention has at least the advantages of small size, wide bandwidth, and beautiful device appearance, and therefore it is suitable for application in a variety of mobile communication devices.

Note that the above element sizes, element shapes, and frequency ranges are not limitations of the invention. An antenna designer can fine-tune these settings or values according to different requirements. It should be understood that the mobile device and antenna structure of the invention are not limited to the configurations of FIGS. 1-7. The invention may merely include any one or more features of any one or more embodiments of FIGS. 1-7. In other words, not all of the features displayed in the figures should be implemented in the mobile device and antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A mobile device, comprising:

a metal mechanism element, having a slot, wherein the slot has a first closed end and a second closed end;

a ground plane;

a first parasitic radiation element, coupled to the metal mechanism element, and extending across the slot;

a second parasitic radiation element, coupled to the metal mechanism element, and extending across the slot;

a feeding radiation element, having a feeding point, wherein the feeding radiation element is positioned between the first parasitic radiation element and the second parasitic radiation element; and a dielectric substrate, disposed adjacent to the metal mechanism element, wherein the feeding radiation element, the first parasitic radiation element, and the second parasitic radiation element are disposed on the dielectric substrate;

wherein an antenna structure is formed by the feeding radiation element, the first parasitic radiation element, the second parasitic radiation element, and the slot of the metal mechanism element;

wherein the antenna structure covers at least a first frequency band, and a length of the slot is shorter than 0.48 wavelength of the first frequency band.

2. The mobile device as claimed in claim 1, wherein the ground plane is a conductive material extending from the metal mechanism element onto the dielectric substrate, and the ground plane and the first parasitic radiation element or the second parasitic radiation element at least partially extend in opposite directions.

3. The mobile device as claimed in claim 1, wherein the antenna structure has an asymmetrical pattern.

4. The mobile device as claimed in claim 1, wherein the feeding radiation element has a variable-width structure.

5. The mobile device as claimed in claim 1, wherein the slot is positioned between a first side region and a second side region, a first end of the first parasitic radiation element and a first end of the second parasitic radiation element are coupled to the metal mechanism element within the first side region, the feeding point is positioned in the second side region, and a second end of the first parasitic radiation element and a second end of the second parasitic radiation element extend across the slot into the second side region.

6. The mobile device as claimed in claim 1, wherein at least a portion of each of the first parasitic radiation element and the second parasitic radiation element substantially has a U-shape, and the feeding radiation element is at least partially disposed between an open side of the first parasitic radiation element and an open side of the second parasitic radiation element.

7. The mobile device as claimed in claim 1, wherein the first parasitic radiation element further comprises a protruding portion, and the protruding portion substantially has a straight-line shape.

8. The mobile device as claimed in claim 1, wherein the antenna structure further covers a second frequency band, the first frequency band is from 2400 MHz to 2500 MHz, and the second frequency band is from 5150 MHz to 5850 MHz.

9. The mobile device as claimed in claim 8, wherein a length of the first parasitic radiation element is substantially equal to 0.5 wavelength of the second frequency band.

10. The mobile device as claimed in claim 8, wherein a length of the second parasitic radiation element is substantially equal to 0.5 wavelength of the second frequency band.

11. The mobile device as claimed in claim 1, further comprising:

a first additional radiation element, coupled to the first parasitic radiation element, wherein the first additional radiation element substantially has a straight-line shape.

12. The mobile device as claimed in claim 1, further comprising:

a second additional radiation element, coupled to the second parasitic radiation element, wherein the second additional radiation element substantially has a straight-line shape.

13. The mobile device as claimed in claim 1, further comprising:

a tuning radiation element, extending across the slot, wherein the tuning radiation element comprises a first portion and a second portion, and the first portion and the second portion are respectively coupled to the metal mechanism element; and a circuit element, coupled between the first portion and the second portion of the tuning radiation element.

14. The mobile device as claimed in claim 13, wherein a vertical projection of the circuit element is completely inside the slot.

15. The mobile device as claimed in claim 13, wherein the circuit element is a resistor, an inductor, a capacitor, a switch element, or a combination thereof.

16. The mobile device as claimed in claim 1, wherein the antenna structure further covers a second frequency band, a third frequency band, and a fourth frequency band, the first frequency band is from 699 MHz to 960 MHz, the second frequency band is from 1710 MHz to 2690 MHz, the third frequency band is from 3400 MHz to 4300 MHz, and the fourth frequency band is from 5150 MHz to 5925 MHz.

17. The mobile device as claimed in claim 16, wherein a length of the first parasitic radiation element is substantially equal to 0.5 wavelength of the second frequency band.

18. The mobile device as claimed in claim 16, wherein a length of the second parasitic radiation element is substantially equal to 0.5 wavelength of the third frequency band.

19. The mobile device as claimed in claim 1, further comprising:

a thickening layer, disposed between the dielectric substrate and the metal mechanism element.

20. An antenna structure, comprising:

a metal mechanism element, having a slot, wherein the slot has a first closed end and a second closed end;

a ground plane;

a first parasitic radiation element, coupled to the metal mechanism element, and extending across the slot;

a second parasitic radiation element, coupled to the metal mechanism element, and extending across the slot;

a feeding radiation element, having a feeding point, wherein the feeding radiation element is positioned between the first parasitic radiation element and the second parasitic radiation element; and a dielectric substrate, disposed adjacent to the metal mechanism element, wherein the feeding radiation element, the first parasitic radiation element, and the second parasitic radiation element are disposed on the dielectric substrate;

wherein the antenna structure covers at least a first frequency band, and a length of the slot is shorter than 0.48 wavelength of the first frequency band.

* * * * *